United States Patent [19]

Chance et al.

[11] 4,183,149

[45] Jan. 15, 1980

[54] WEB DRYING ROLL

[75] Inventors: James L. Chance; Richard E. Hergert, both of Rockton, Ill.

[73] Assignee: Beloit Corporation, Beloit, Wis.

[21] Appl. No.: 883,127

[22] Filed: Mar. 3, 1978

[51] Int. Cl.[2] ..... F26B 3/24

[52] U.S. Cl. ..... 34/41; 34/119; 34/124; 165/91; 165/94

[58] Field of Search ..... 165/90, 91, 94; 15/21 B, 52, 256; 34/85, 119, 124, 125, 39-41

[56] References Cited

U.S. PATENT DOCUMENTS

| | | | |
|---|---|---|---|
| 2,259,024 | 10/1941 | Cleveland | 165/91 |
| 2,545,917 | 3/1951 | Cowie | 34/124 |

FOREIGN PATENT DOCUMENTS

| | | | |
|---|---|---|---|
| 288645 | 3/1965 | Netherlands | 165/95 |

*Primary Examiner*—John J. Camby
*Assistant Examiner*—Larry I. Schwartz
*Attorney, Agent, or Firm*—Hill, Van Santen, Steadman, Chiara & Simpson

[57] ABSTRACT

A method and apparatus for drying a traveling fibrous web such as paper including a hollow cylindrical dryer drum with means for directing a flow of steam into the drum and for removing condensate from the inside of the drum and positioning an axially elongate bristle support with bristles projecting radially outwardly so that the support and bristles form a brush of substantial uniform axial density to generate a visual high level of turbulence in the condensate and decrease the rotational speed of the layer of rimming condensate formed on the inner surface of the drum shell.

10 Claims, 4 Drawing Figures

WEB DRYING ROLL

BACKGROUND OF THE INVENTION

The invention relates to improvements in rotational dryer drums of the type used for paper making machines wherein a traveling web of paper passes over the surface of a rotationally mounted drum for evaporating the moisture from the web and pertains particularly to a method and mechanism for increasing the transfer of heat from the steam within the drum to the drum shell and decreasing the insulating effect of the rimming condensate which forms against the inner surface of the shell periphery.

In a paper making machine the drying section generally includes a series of cylindrical dryer drums which are rotationally mounted and which are spaced so that the paper web is threaded sinuously over the drums to be in engagement with the surface of the drum or to be carried by a felt over the surface of the drum so that the web is heated for evaporating the moisture therefrom. In a high speed paper making machine, the dryer section consisting of a large number of these dryer drums takes up the largest amount of machine room floor space, and is a critical part of the machine. In speeding up the operation of the machine, it is necessary to increase the number of drums, and the space required for such drums is a limiting factor in designing the speed of the paper making machine. It is imperative to obtain the maximum drying effect for a web during its time of contact with the dryer drums and it is, therefore, imperative that the drum be heated to the maximum permissible temperature and that this heat be maintained constant and uniform during operation. The amount of heat energy absorbed by the drying web is very considerable, and the requirements of high performance, quality of production, and efficiency of production, demand that there be maximum heat energy transfer from the steam which is used to heat the dryer drum to the shell which contacts the felt carrying the paper web. A physical phenomena of operation which limits heat transfer from the steam within the drum is the formation of condensate within the drum which condensate forms a layer on the inner surface of the drum shell having insulating effect and limiting the conductive heat transfer from the steam to the metal of the shell. Efforts have been substantial to reduce the effect of this rimming insulating layer of condensate and condensate removal pipes and other devices have been provided to maintain the layer of condensate at a minimum thickness, but it is impossible to eliminate the layer completely, and even a very thin layer of condensate will have an insulating effect. An example of one such effort to reduce the insulating effect of the condensate is shown in U.S. Pat. No. 3,724,094 which is an extension of efforts illustrated and described in U.S. Pat. No. 3,217,426. These patents employ the expedient of providing axially extending bars along the inner surface of the drum shell so as to cause a surface wave to form or a sloshing of the condensate in the spaces between the bars, and the above patents show attempted improvements on a concept of providing this wave or sloshing effect as disclosed in a periodical referred to in U.S. Pat. No. 3,724,094, "Das Papier", Vol. 14 No. 10*a*, of Oct. 1960 (pages 600–609). The efforts exemplified by the above patents and article meet with disadvantages in that the physical space required for the bars prevents positioning condensate removal devices in very close running relationship with the inner surface of the shell. Other disadvantage is encountered in that the sloshing of the condensate will have an adverse effect on the rotational operation of the drum and will cause an erratic power demand with cascading of the water. This is especially disadvantageous because it is essential that the dryer drums be operated at uniform speed and nonuniform power requirements will adversely affect attempts to maintain this uniform speed.

It is accordingly an object of the present invention to provide an improved method and mechanism for decreasing the heat transfer retarding effect of the layer of condensate which forms on the inner surface of a rotational dryer drum.

A further object of the invention is to provide a means and method to decrease the insulating and heat retarding effect of the layer of condensate on the inner surface of a dryer drum which does not adversely affect or interfere with any other factors of performance of the drum, which embodies mechanism which is inexpensive and simple to construct and which can be mounted in new drums or utilized in existing drums, which is self-cleaning and does not require continual attention or adjustment which is easy and inexpensive to mount, which does not interfere with condensate removal, which can operate without contact with the drum so that it does not increase power requirements and which does not cause an erratic power demand for rotation of the drum.

A still further object of the invention is to provide a unique means for increasing heat transfer from the steam within the drum to the outer surface which uniquely and unexpectedly operates with the existence of a layer of condensate within the drum and yet reduces its heat transfer retarding effect so that calculated insulation properties of the layer of condensate as computed by existing formulas do not apply.

Other objects, advantages and features, as well as equivalent methods and structures which are intended to be covered herein, will become more apparent with the teaching of the principles of the present invention in connection with the disclosure of the preferred embodiments in the specification, claims, and drawings, in which:

DRAWINGS

DESCRIPTION

Figure 1:
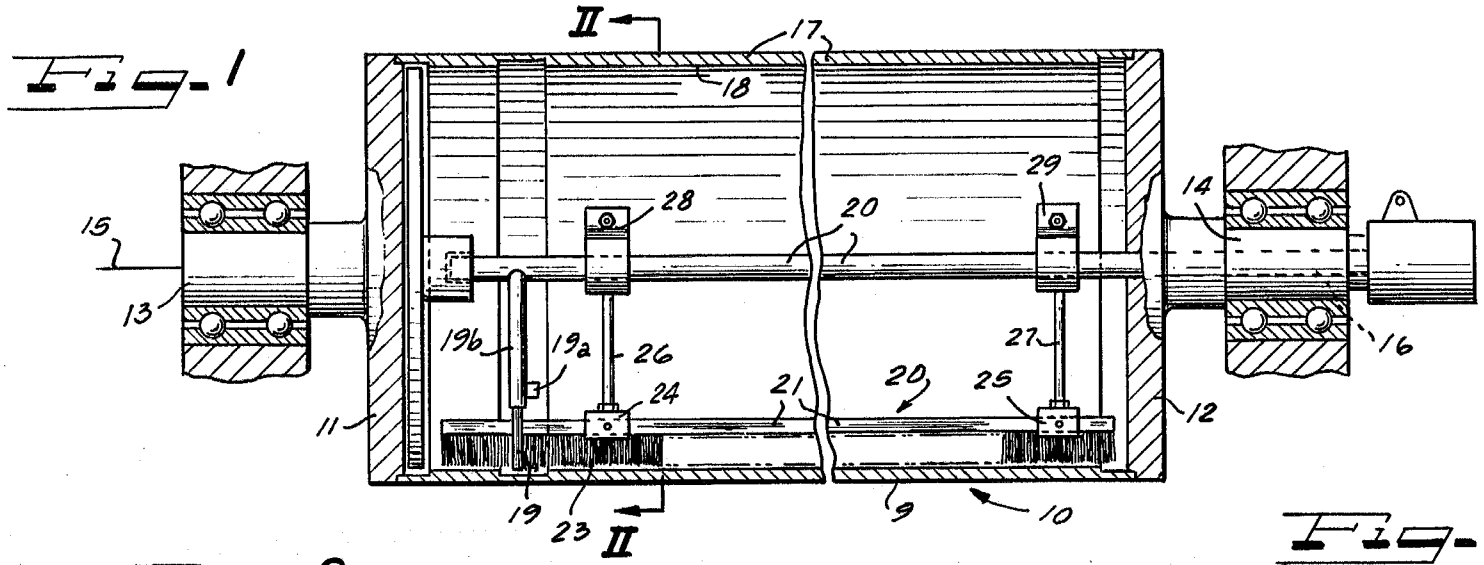
FIG. 1 is a vertical sectional view taken through the axis of a dryer drum constructed and operating in accordance with the principles of the present invention.
Figure 2:
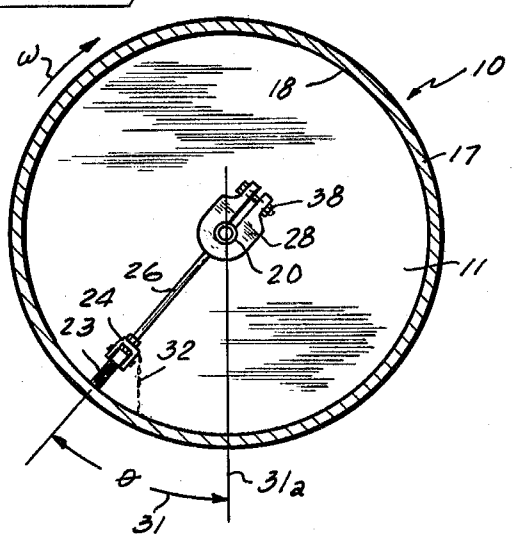
FIG. 2 is a vertical sectional view taken substantially along line II—II of FIG. 1.

As illustrated in FIGS. 1 and 2, a dryer drum 10 is provided for heat transfer support of a traveling paper web, and has an annular thin shell 9 with end walls 11 and 12. The end walls have axial shafts 13 and 14, which are rotationally mounted in bearings, not shown, for supporting the drum.

A rotary steam gland is provided, not shown, for directing a flow of heated steam into the interior of the drum, as indicated by a schematic supply line 15. As heat is transferred from the steam to the drum shell, condensate forms, and at operating rotational speeds the condensate will form a layer on the inner surface 18 of the shell which may be called rimming, and this condensate is removed being pumped out through a removal pipe 16 extending axially from the drum. The removal of the condensate from the inner surface of the drum is accomplished through a siphon tube 19 extending radially with its open end adjacent the inner surface 18 of the drum, and the tube leads up through an axial connecting pipe within the central axis 20 of the drum, to connect to the removal pipe 16. The shaft 20 is arranged to be stationary so as to support the condensate removal tube 19 in a predetermined position. Generally, there will be a plurality of condensate removal tubes such as 19 along the periphery of the inner surface of the drum to maintain a layer of water condensate at a minimum thickness, but since there cannot be actual rubbing engagement with the end of the condensate removal tube and the surface of the drum, some condensate layer will always remain, and this layer will have an insulating effect and reduce the heat transfer from the steam within the drum to the metal of the shell.

The outer surface 17 of the shell is smooth for carrying the paper web, which is usually on a traveling dryer felt.

In accordance with the principles of the invention, separate from the condensate removal means, there is provided a device which will generate a level of visual turbulence in the rimming layer of condensate. This turbulence is generated in the preferred arrangement by an axially extending elongate brush with the end of the brush bristles being in close running relationship to the inner surface of the drum shell. The arrangement as shown generates a visual turbulence with the condensate appearing very frothy over the entire inner surface of the condensate. The brush bristles are shown at 23 supported on a brush back 22 to form the brush assembly 21. For mounting the brush in its predetermined circumferential location within the drum, the brush is provided with holders 24 and 25 which are supported on radial rods 26 and 27 which in turn are mounted on blocks 28 and 29 secured to the stationary center shaft 20 of the drum. The blocks 28 and 29 are provided with a rotational adjustment means, and for this purpose are split so as to clamp onto the center shaft 20 by a tightening bolt 30, FIG. 2. The brush 21 will be positioned in a predetermined rotational position within the shell at an angle $\theta$ shown by the arrowed line 31, with a vertical line 31*a*. The rotational position of the brush 21 may be varied and in one preferred arrangement, is positioned so that droplets 32 will roll off the brush, and it has been discovered that these droplets descending gravitationally onto the inner surface of the rimming condensate will generate a turbulence in the layer of condensate causing the layer to collapse which will coact and augment the operation of the brush bristles. Essentially the brush bristles slow the outer layer of condensate.

The brush bristles may be positioned so that the ends of the bristles are spaced slightly from the surface 18 of the shell or may be in contact therewith, such relationship being referred to herein as close running engagement with the inner surface of the shell. It has been discovered that with the positioning of the bristles spaced inwardly from the shell, but in engagement with the surface of the layer of condensate, the same turbulence and decreased condensate layer thickness resulted. In other words, the bristles in engagement solely with the surface of the layer apparently affected the layer through its entire depth in an unexpected manner. The result, of course, was to reduce the insulating effect of the condensate and to produce a high heat transfer coefficient. The brush would be effective at essentially any depth condensate which can be made to resonate, but the greatest degree of turbulence was obtained with the thickness of the condensate layer equalling 0.18". For this purpose, it is preferred that the stationary siphon pipe 19 be radially adjustable so as to coactingly control the location of its outer tip relative to the surface 18 of the drum. This can be done by providing a radial siphon pipe 19 which slides in a supporting sleeve 19*b* and is adjustably locked by a tightening member 19*a*. Other forms of radial adjustment, of course, may be employed.

Figure 3:
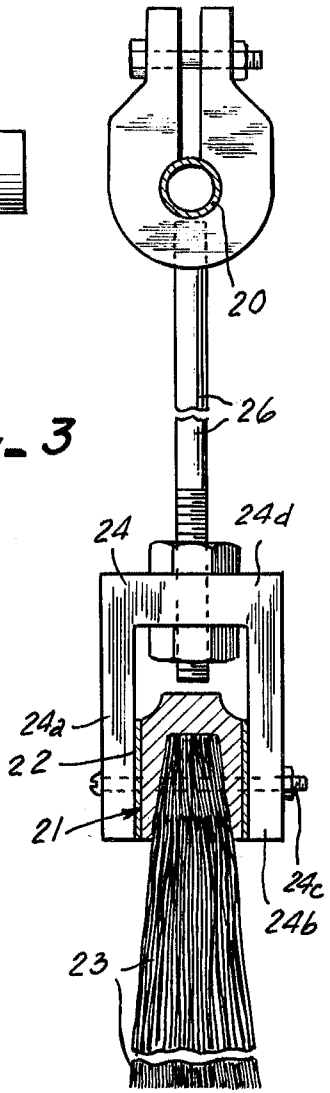
FIG. 3 is an enlarged sectional view showing further details of a form of brush arrangement with a view showing a portion of the section taken along line II—II of FIG. 1.

FIG. 3 illustrates in some detail one form of brush arrangement which may be employed. The holder 24 is provided with an inverted U-shape having a back 24*d* to which the support rod 26 is bolted. The holder has side legs 24*a* and 24*b* in which the back of the bristles 23 are mounted and a clamping bolt 24*c* extends through the brush to lock the bristles in place. The bristles are preferably of stainless steel, but may be of brass or other materials.

Figure 4:
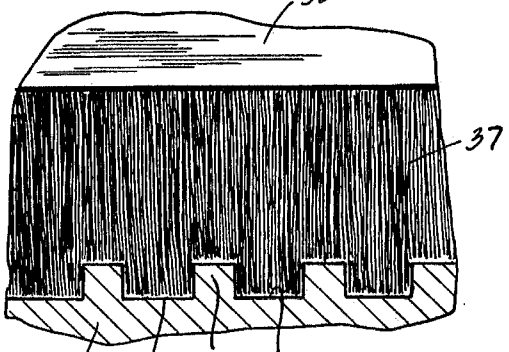
FIG. 4 is a fragmentary detailed view of a portion of a ribbed dryer drum.

In FIG. 4, a ribbed dryer drum is employed with a shell 33 having ribs 34 therein with alternate grooves 35. The condensate removal tubes will project into each of the grooves in the manner which is known to those versed in the art, and the bristles 37 of the brush 38 will either be alternately shortened and lengthened so that they project into the base of each of the grooves 35 and are in close running relationship with the top of the ribs. Alternately, a brush with bristles of uniform length may be employed with the bristles which engage the ribs deflecting due to their engagement. Also, a brush arrangement may be employed with bristles located to only extend only into the grooves 35 so that no bristles will be present at the position of the ribs.

While dripping condensate was found to fall onto the surface of the rimming condensate from the brush at various brush positions, at an angle of 180°, a good fall of collapsing condensate was found to exist.

In experiments wherein the thickness of the rimming layer of condensate was attempted to be controlled, it was difficult to obtain thicknesses less than 0.05"–0.10" range. The heat transfer factor $h_c$ for this condensate lever would be expected by calculations to be in the 100–200 BTU/hour FT$^{2}$° F. Using the stationary brush arrangement as illustrated in the drawings, heat conductivity $h_c$ was in the 700 range which represented a 3.5–7.0 fold increase.

Thus, it will be seen that we have provided an improved steam dryer drum and means of increasing the heat transfer to the drum shell which meets the objectives and advantages above set forth and increases the capability and capacity of dryer drums for making higher operational speeds possible and shorter lengths of dryer drum runs.

We claim as our invention:

1. In a hollow cylindrical dryer drum having an outer shell and mounted for rotation for drying contact with a traveling fibrous web, the combination comprising:

means connected to the drum for directing a flow of steam into the interior of the drum for heating the peripheral outer surface of the shell;

a condensate removal means within the drum for removing condensate from the inner surface of the periphery of the shell;

a bristle support within the drum extending axially along the inner periphery having a plurality of cantileverly supported bristles extending radially outwardly into close running contact with the inner peripheral shell surface and substantially uniformly distributed along the axial length; said bristles having sufficient stiffness for resisting the movement of condensate with rotation of the drum and generating a visual high level of turbulence in the condensate decreasing the rotational speed of the layer of condensate carried with the drum shell causing the layer of rimming condensate to collapse for a substantial increase in heat transfer from the steam to the drum shell;

and means for stationarily mounting said bristle support within the drum.

2. In a hollow cylindrical dryer drum having an outer shell and mounted for rotation for drying contact with a traveling fibrous web, the combination comprising:

means connected to the drum for directing a flow of steam into the interior of the drum for heating the peripheral outer surface of the shell;

a condensate removal means within the drum for removing condensate from the inner surface of the shell periphery; and a plurality of flexible members nonrotationally positioned adjacent the inner periphery of the shell at a predetermined circumferential location and engaging the rotating condensate generating a turbulence in the condensate layer on the inner periphery of the drum shell causing the condensate layer to collapse for substantially increasing heat transfer without decreasing the quantity of condensate by said engagement with the condensate and being otherwise independent of said removal means.

3. In a hollow cylindrical dryer drum having an outer shell and mounted for rotation for drying contact with a traveling fibrous web, the combination constructed in accordance with claim 2:

wherein said members are in the form of thin flexible cantileverly supported bristles projecting radially outwardly toward the inner surface of the drum shell.

4. In a hollow cylindrical dryer drum having an outer shell and mounted for rotation for drying contact with a traveling fibrous web, the combination constructed in accordance with claim 3:

wherein said bristles have their outer ends spaced from the inner surface of the shell but located to be in engagement with the surface of the layer of water rimming the shell.

5. In a hollow cylindrical dryer drum having an outer shell and mounted for rotation for drying contact with a traveling fibrous web, the combination constructed in accordance with claim 3:

wherein the outer tips of said bristles are in contacting surface engagement with the inner surface of the shell.

6. In a hollow cylindrical dryer drum having an outer shell and mounted for rotation for drying contact with a traveling fibrous web, the combination constructed in accordance with claim 3:

including means for adjustably changing the rotational position of said members around the periphery of the shell to a predetermined angle relative to the drum.

7. In a hollow cylindrical dryer drum having an outer shell and mounted for rotation for drying contact with a traveling fibrous web, the combination constructed in accordance with claim 3:

wherein said members are located at a circumferential position wherein condensate will gravitationally drip from said members onto the inner surface of the layer of condensate rimming the shell generating additional turbulence in the condensate layer for increased heat transfer from the steam to the shell.

8. The method of increasing heat transfer from steam within a hollow cylindrical dryer drum to the outer surface of the outer shell thereof, comprising the steps:

directing a flow of steam into the interior of the drum for providing heat energy to be transferred to the outer shell;

removing continually condensate forming on the inner surface of the outer shell with a thin layer of rimming condensate remaining on the inner surface of the outer shell;

and generating a visual high level of turbulence in the rimming layer of condensate causing the rimming condensate to collapse by projecting a plurality of bristles toward the inner surface of the shell in close running relation to the shell surface.

9. The method of increasing heat transfer from steam within a hollow cylindrical dryer drum to the outer surface of the outer shell thereof including the steps of claim 8:

including selectively adjusting the position of generation of said high level turbulence circumferentially for maximum effect in increase of heat transfer.

10. The method of increasing heat transfer from steam within a hollow cylindrical dryer drum to the outer surface of the outer shell thereof including the steps of claim 8:

and additionally generating dripping of condensate droplets onto the surface of the condensate disturbing the layer of condensate for increasing heat transfer to the drum shell.

* * * * *